United States Patent [19]

Gallo

[11] Patent Number: 4,776,492

[45] Date of Patent: Oct. 11, 1988

[54] COMBINATION TOOTHPASTE DISPENSER AND TOOTHBRUSH HOLDER

[76] Inventor: Carmen S. Gallo, 2648 N. 72nd Ct., Elmwood Park, Ill. 60635

[21] Appl. No.: 151,155

[22] Filed: Feb. 1, 1988

Related U.S. Application Data

[63] Continuation-in-part of Ser. No. 915,782, Oct. 6, 1986, abandoned.

[51] Int. Cl.[4] ..... A47G 29/08; B67D 5/06

[52] U.S. Cl. ..... 222/183; 222/192; 222/325

[58] Field of Search ..... 222/78, 93–95, 222/105, 106, 182, 183, 184, 192, 256, 257, 259, 260, 340, 341, 207, 209, 372, 383, 385, 391, 386, 401, 402.13, 402.15, 567, 570, 325–327, 130, 131; 248/108; 206/277, 234, 38, 362.1, 362.2, 362.3, 15.2, 15.3

[56] References Cited

U.S. PATENT DOCUMENTS

| | | | |
|---|---|---|---|
| 2,771,219 | 11/1956 | Dewey | 222/93 |
| 2,904,225 | 9/1959 | Earles, Jr. | 222/183 |
| 2,937,790 | 5/1960 | Lapeyre | 222/94 |
| 3,091,367 | 5/1963 | Fredrickson | 222/402.13 X |
| 3,101,160 | 8/1963 | Picot | 222/183 |
| 3,105,612 | 10/1963 | Krasnoff et al. | 222/93 X |
| 3,347,423 | 10/1967 | Rahn et al. | 222/183 |
| 3,540,628 | 11/1970 | Trosch | 222/183 |
| 4,020,975 | 5/1977 | Stauffer | 222/93 |
| 4,098,436 | 7/1978 | Kohlbeck | 222/182 |
| 4,437,591 | 3/1984 | von Schuckman | 222/391 |
| 4,515,298 | 5/1985 | Czech | 222/383 X |
| 4,673,106 | 6/1987 | Fishman | 222/192 X |
| 4,705,194 | 11/1987 | Judge | 222/93 X |

FOREIGN PATENT DOCUMENTS

| | | | |
|---|---|---|---|
| 3005925 | 9/1981 | Fed. Rep. of Germany | 222/207 |
| 3417312 | 11/1985 | Fed. Rep. of Germany | 222/92 |

*Primary Examiner*—Kevin P. Shaver
*Attorney, Agent, or Firm*—John J. Murphey

[57] ABSTRACT

A combination toothpaste dispenser and tooth brush holder, for use with a toothpaste pump-tube dispenser characterized by a narrow, upstanding paste container tube and top-mounted, pump plunger and spaced-apart dispenser port. An elongated housing of terminal length adapted to extend down over the pump-tube dispenser, a bracket extending outward from the housing having a series of apertures for receipt of tooth brush handles and an exposed pump plunger reciprocally mounted in the housing at its upper end for registration with the pump plunger of the toothpaste pump-tube dispenser and a detachable nozzle assembled in the upper housing end to receive toothpaste discharged from the dispenser port, of the pump tube dispenser, and convey it out from the housing in response to pressure applied to the exposed pump plunger. The detachable nozzle contains a hollow dip leg at one end thereof for partially penetrating the pump-tube dispenser port to form a non-leaking seal therebetween.

12 Claims, 6 Drawing Sheets

COMBINATION TOOTHPASTE DISPENSER AND TOOTHBRUSH HOLDER

CROSS-REFERENCE TO RELATED APPLICATIONS

This is a Continuation-in-Part of my previously filed application titled "COMBINATION TOOTHPASTE DISPENSER AND TOOTHBRUSH HOLDER", filed 10/06/86 and given Ser No. 915,782, now abandoned.

BACKGROUND OF THE INVENTION

1. Field of the Invention

This invention pertains to the field of bathroom appliances. More particularly, it pertains to dental implements of the type used in the bathroom and specifically to a portable combination toothpaste dispenser and toothbrush holder for use by all members of the family.

2. Description of the Prior Art

Dental caries, or "cavities" as they are otherwise known, have been with us since the beginning. Virtually everything that is edible has some deleterious effect on the teeth and, unless measures are taken to ward off those effects, the teeth become decayed and may ultimately be rendered useless. Brushing the teeth with various chemicals and mild grinding compounds, the combination known as "dentrifrices", has proven to be the best overall decay preventative.

Marketing dentrifices is an intense business. The public is constantly plied with products in powder and liquid from as well as in semi-liquid paste form called "toothpaste". They contain various chemicals to affect the taste, smell and color, as well as harden the tooth enamel against decay, all with the idea of convincing buyers that one product is better than or offers advantages over another. Since eating is a cradle-to-grave habit, it is thought that the earlier one begins practicing good dental habits, such as brushing after every meal, the better the overall health of the teeth will fare. To this end, much emphasis is placed on making the toothbrushing operation desirable with children.

Between liquids, powders and semi-liquids or pastes, toothpaste has traditionally been desired by families wanting to teach their children to brush. Liquids are easily spilled and powders can be all too easily dispersed by sneezing; toothpaste seems to be the safest for children and most grownups. While various colors, including stripes, have been imparted to pastes, and while the flavors have been varied to make them more palatable, by far the most attention and emphasis has been placed on making a toothpaste dispenser that is easy to handle, convenient, safe and fun to use. Dispensers such as those shown in U.S. Pats. Nos. 2,906,479; 3,155,279; 3,178,060; and, 4,020,975 are all, to some extent, attempts to make toothpaste dispensing more convenient—almost to the point of being fun.

Recently, toothpaste has been marketed in a narrow pump-tube dispenser that is characterized by a narrow, upstanding paste-container tube with top-mounted pump plunger and spaced-apart dispenser port. These dispensers are designed to dispense toothpaste from the port onto a brush held close by upon activating the plunger. These pump-tubes have met with a noticeable degree of public acceptance. Unfortunately, they are deficient in that (1) the narrow base allows them to topple over onto the floor where some toothpaste may be thereafter smeared into the floor or rug; (2) the dexterity required to hold the pump-tube in one hand, hold a toothbrush in the other hand and operate the pump-tube plunger is often beyond the capabilities of small children; (3) the pump-tube plunger is located off-center, is small and narrow such that, when pressed, the tube tends to flip over from its narrow base onto its side and slide off the wash stand; (4) on at least one model the dispenser port is aimed upward so that idle pressing of the plunger (such as by children playing in the bathroom) causes paste to well up out of the port and ooze back over the top of the pump-tube creating an unsightly mess; (5) if not used regularly, the dispenser port may clog with dried paste and the port is not removable for ease in cleaning and, (6) the removable top or cover gets regularly smeared with toothpaste and, if not cleaned up, results in a discolored glob that detracts from the overall esthetics of the product.

SUMMARY OF THE INVENTION

The instant invention is a unique combination dispenser for toothpaste and holder for toothbrushes that utilizes the modern pump-tube dispenser but brings it within the abilities of persons of all ages and gathers together the toothpaste dispenser and the toothbrushes in one convenient location.

This inventive dispenser accepts toothpaste pump-tubes of various lengths so that refills may be selected from a rather wide range. The plunger is vertically moveable and given a wide, easy-to-push top; the dispenser is very solid and made more stable by a large, outwardly flared base flange so that dispensing can be accomplished by merely pressing the wide plunger, a task easily with the capability of the smallest child. The dispenser port is moved from the top to the side where it provides more convenience for loading the toothbrush with paste. The dispenser contains a unique spout that not only is removable for easy cleaning but penetrates into the dispensing port of the pump-tube to effect a solid, leak-proof connection. Finally, there is no removable top to be mishandled; the device is totally contained and presents a fine appearance as well as removing the aforesaid problems associated with pump-tubes.

Accordingly, the main object of this invention is a device that uses the modern pump-tube as the charge of toothpaste and locates a toothpaste dispenser and toothbrushes in one convenient location. Other objects include a device that presents a stable base for safer use, a device that expands the traditional narrow pump-tube plunger into a large-topped reciprocating plunger allowing one-handed operation so that the other hand is free to hold the toothbrush; a device that moves the top-mounted dispenser ports of the pump-tube to a side location for greater ease in loading the toothbrush and to provide an area less likely to become contaminated; a device with a removable and washable dispenser spout that has the additional function of penetrating into the pump-tube dispenser port to effect a non-leaking connection therebetween; and, finally, a device free of a cover that, on the pump-tube, was a source of dried toothpaste buildup and possibly a site for contamination to develop.

These and other objects of the invention will become more apparent when the following Description of the Preferred Embodiment is read along with the drawings appended hereto. The scope of propriety rights this inventor seeks may be gleaned from a careful reading of the Claims that conclude this specification.

DESCRIPTION OF THE PREFERRED EMBODIMENT

Figure 1:
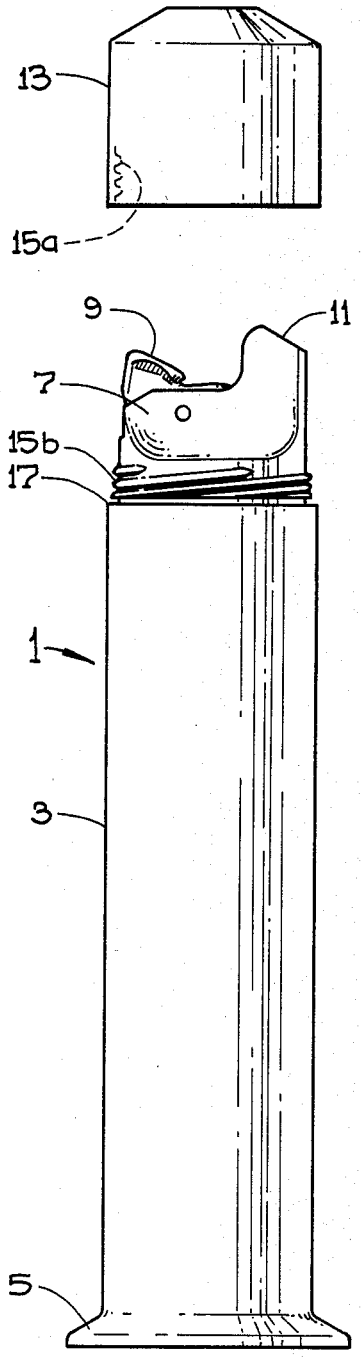
PRIOR ART FIG. 1
FIG. 1 is a side elevational view of one of the pump-tubes useful in this invention.
Figure 2:
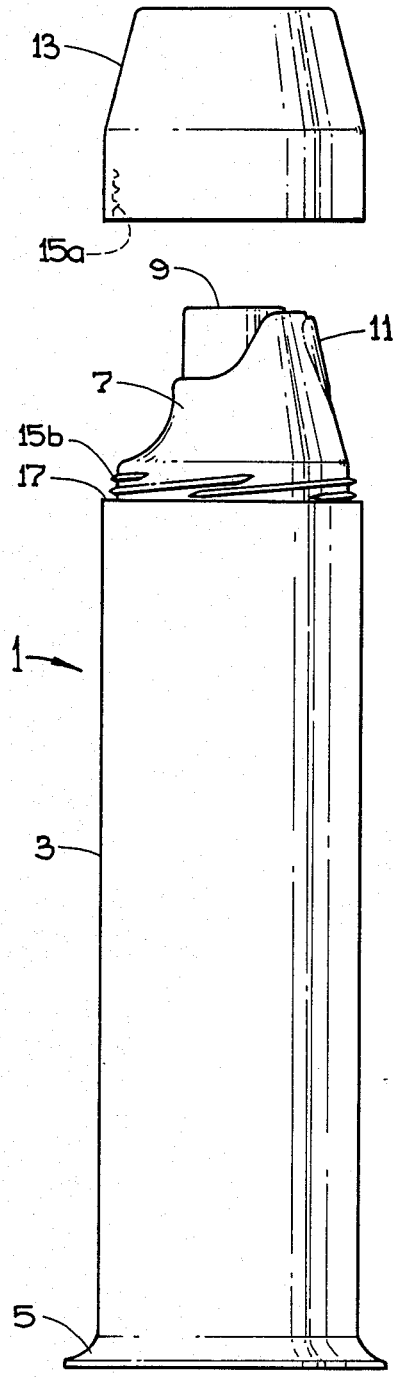
PRIOR ART FIG. 2
FIG. 2 is a side elevational view of another pump-tube that is useful in this invention.

As shown in the drawings, where like elements are identified by like numbers throughout the seven figures, FIGS. 1 and 2 show that the semi-liquid toothpaste usable in this invention is contained within a pump-tube dispenser of terminal length, shown generally at 1. These dispensers are characterized by a narrow upstanding, cylindrical container tube 3, a narrow, flat base portion 5 and a top 7, the latter containing spaced-apart pump plunger 9 and dispenser port 11. A removable, cylindrical cap 13, for covering plunger 9 and port 11, is adapted to be received over top 7 and fastened to container tube 3 by mutually engageable threads 15*a* and 15*b* formed about their respective contacting surfaces located above and adjacent to an outwardly projecting annular circumferential shoulder 17 encircling tube 3 below plunger 9 and dispensing port 11. In operation, plunger 9 is biased upwardly and, upon depressing it against the bias pressure, toothpaste is caused to exude from port 11.

Figure 3:
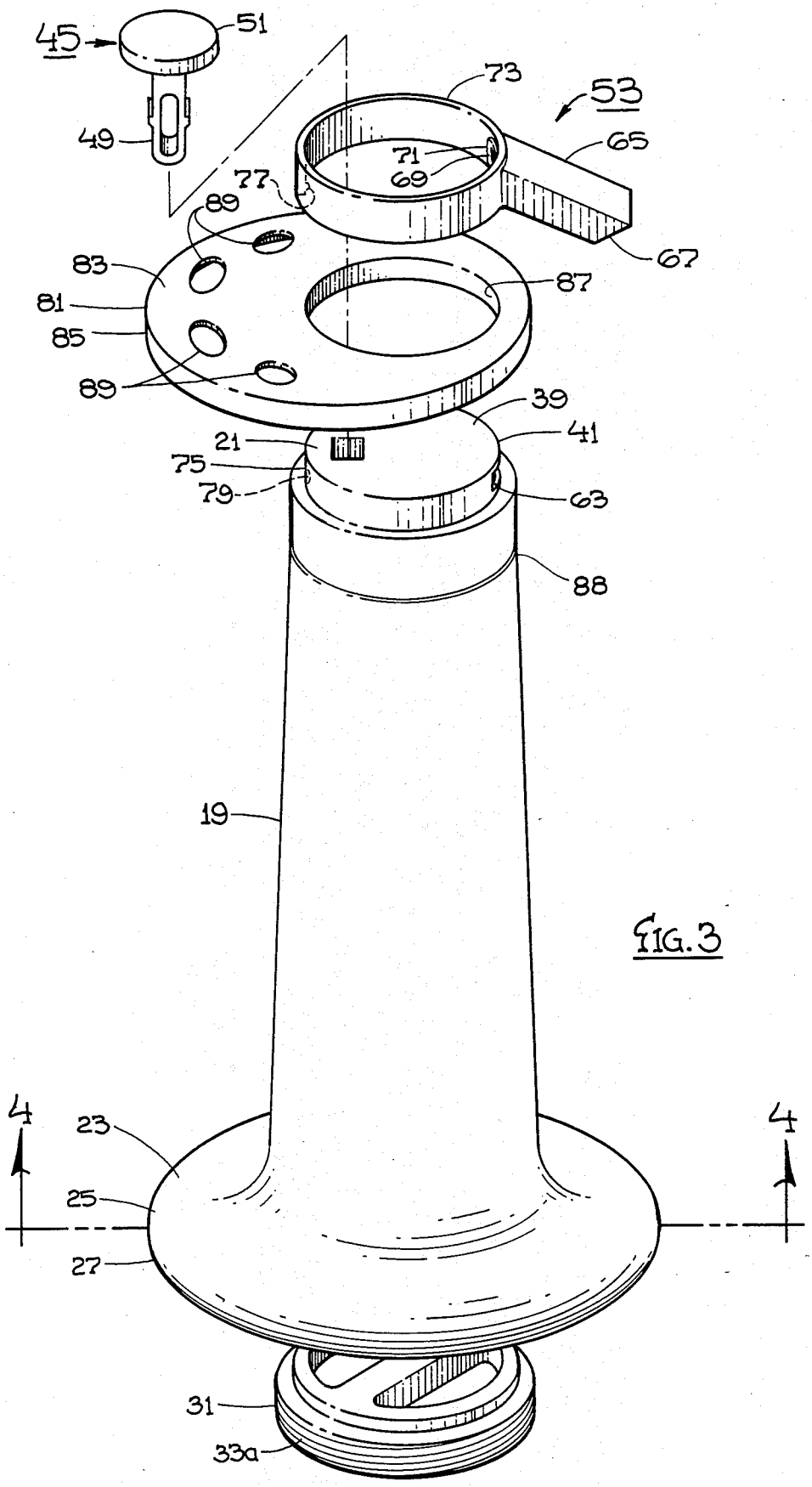
FIG. 3 is a exploded perspective view of one embodiment of the combination toothpaste dispenser and toothbrush holder of this invention.
Figure 4:
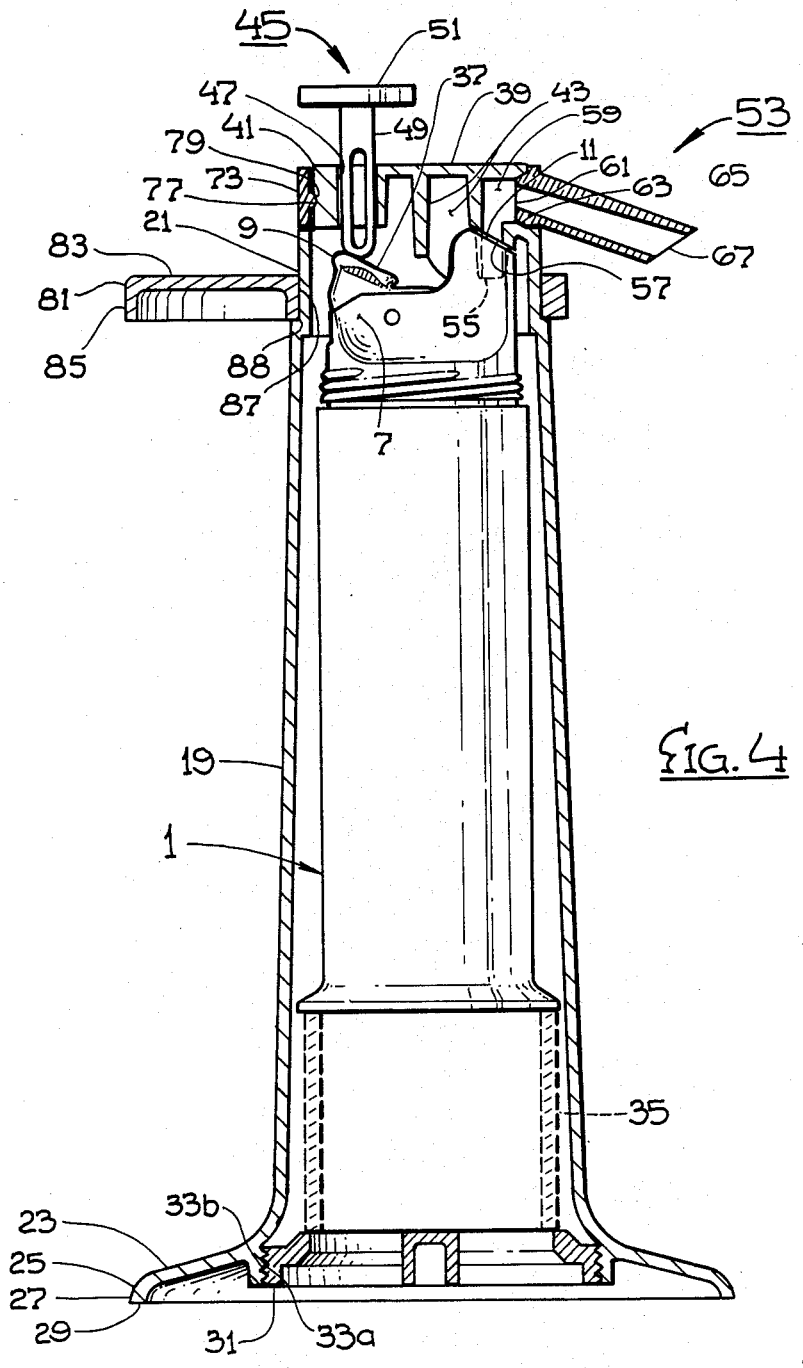
FIG. 4 is a side elevational view, partly in section, taken along lines 4—4 in FIG. 3 showing a pump-tube inserted therein and ready for use.
Figure 5:
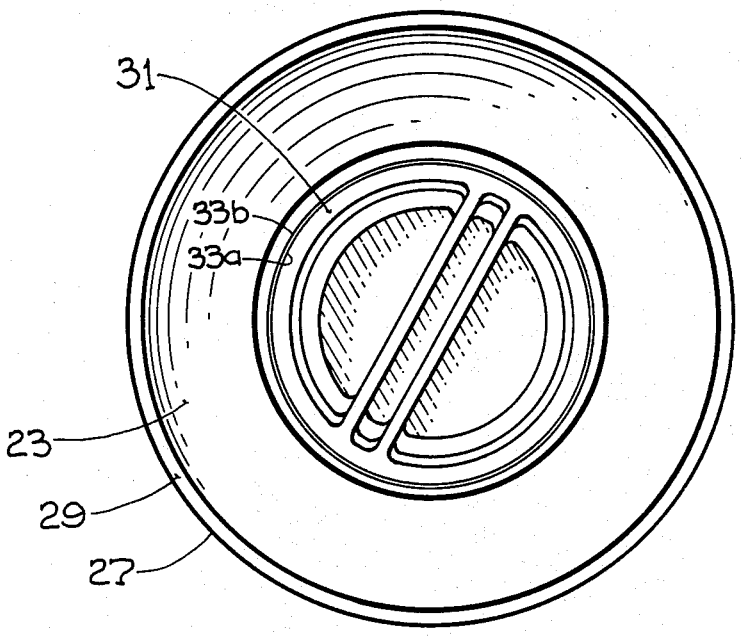
FIG. 5 is a bottom plan view of the embodiment shown in FIG. 3.

In FIGS. 3 and 4 is shown one of the preferred embodiments of this invention. Such embodiment includes an elongated slightly conical tube or housing 19 of terminal length, having spaced-apart upper end 21 and lower end 23, that extends down over pump-tube dispenser 1 to hold it in coaxial receipt therein. Housing 19 terminates at its lower end in an outwardly flared base flange 25 bounded by circular perimeter 27 so as to present a flat base 29 for stable positioning upon a table or wash stand.

A plug base 31 is adapted to be inserted in through base 29 and held in place under flange 25, by interconnecting threads 33*a* and 33*b* or other fastener devices, to hold and retain pump-tube dispenser 1 therein. A separate cylindrical plug extension 35 is optionally provided and shown in position in phantom in FIG. 4 atop or above base plug 31 to take up the space created when using a pump-tube dispenser 1 of shorter overall height.

As shown in FIG. 4, a pump 37 is located in housing 19 at its upper end 21 and comprises a closure plate 39 enclosed by a perimeter 41 that fully engages housing 19 in sealed relationship therewith. A series of vertical webs 43 extend downward from plate 39 and are adapted to abut portions of pump-tube dispenser top 7 to hold pump-tube 1 in rigid coaxial relation in housing 19. On plate 39 is housed exposed plunger means 45 that is arranged in registration over plunger 9 of dispenser 1 in the assembled configuration. Plunger means 45 comprises a vertical passageway 47 formed in plate 39, over pump-tube plunger 9, in which is received in sliding engagement a short pump rod 49, adapted for reciprocal movement therein. A flat button 51 is mounted atop pump rod 49 and, when pressed downward, forces pump rod 49 to engage and depress pump-tube dispenser plunger 9 to force toothpaste out of dispenser port 11. When released, the upward bias of plunger 9 is sufficient to raise rod 49 and button 51 back to their original position for another stroke.

Spaced apart from plunger means 45 is a nozzle means 53, for conveying dispensed toothpaste from port 11 to the toothbrush. Nozzle means 53 comprises a short dip leg 55, molded in or otherwise integral with plate 39, that is of a diameter small enough to penetrate a short distance into dispenser port 11. A laterally extending angular flange 57 surrounds dip leg 55, inward of the end thereof, and is adapted to mate with the bevelled outside surface of pump-tube dispenser 1 adjacent dispenser port 11, to form a leak-tight connection therewith in the assembled configuration. A duct 59 is formed in closure plate 39 and extends from dip leg 55 to the top side of upper housing end 51 below closure plate 39 where it terminates at a port 61 having a laterally extending shallow depression 63. Nozzle means 53 further comprises a short, hollow exterior nozzle 65 having an exterior nozzle end 67, from which the toothpaste is dispensed, an interior nozzle attachment end 69 containing a small boss 71, for receipt in the shallow depression 63, and a mounting ring 73 extending laterally from the sides of interior end 69, for seating engagement in a groove 75 formed in and encircling housing 19 adjacent closure plate 39 in upper end 21. A small raised bump 77 is formed in the interior vertical surface of ring 73 for receipt in a small detent 79 in the vertical wall of groove 75, spaced apart from depression 63, to retain mounting ring 73 in groove 75. When assembled, pump-tube dispensing port 11 is connected to exterior nozzle end 67 through dip leg 55 and duct 59 while nozzle 65 is tightly fastened on housing 19 and anchored against the forces of dispensed semi-liquid toothpaste by mounting ring 73.

A bracket 81, including a radially outwardly extending shelf 83, is mounted over upper housing end 21 for the purpose of holding toothbrushes in close proximity to housing 19. Shelf 83 is defined by outer perimeter 85 and an inner perimeter or aperture 87, said aperture 87 being of a size and shape sufficient to fit snugly into a groove 88 formed below groove 75 in housing 19. Shelf 83 has a series of small apertures 89 formed therein of a size and shape sufficient to accept the handles of toothbrushes hung therein.

Figure 6:
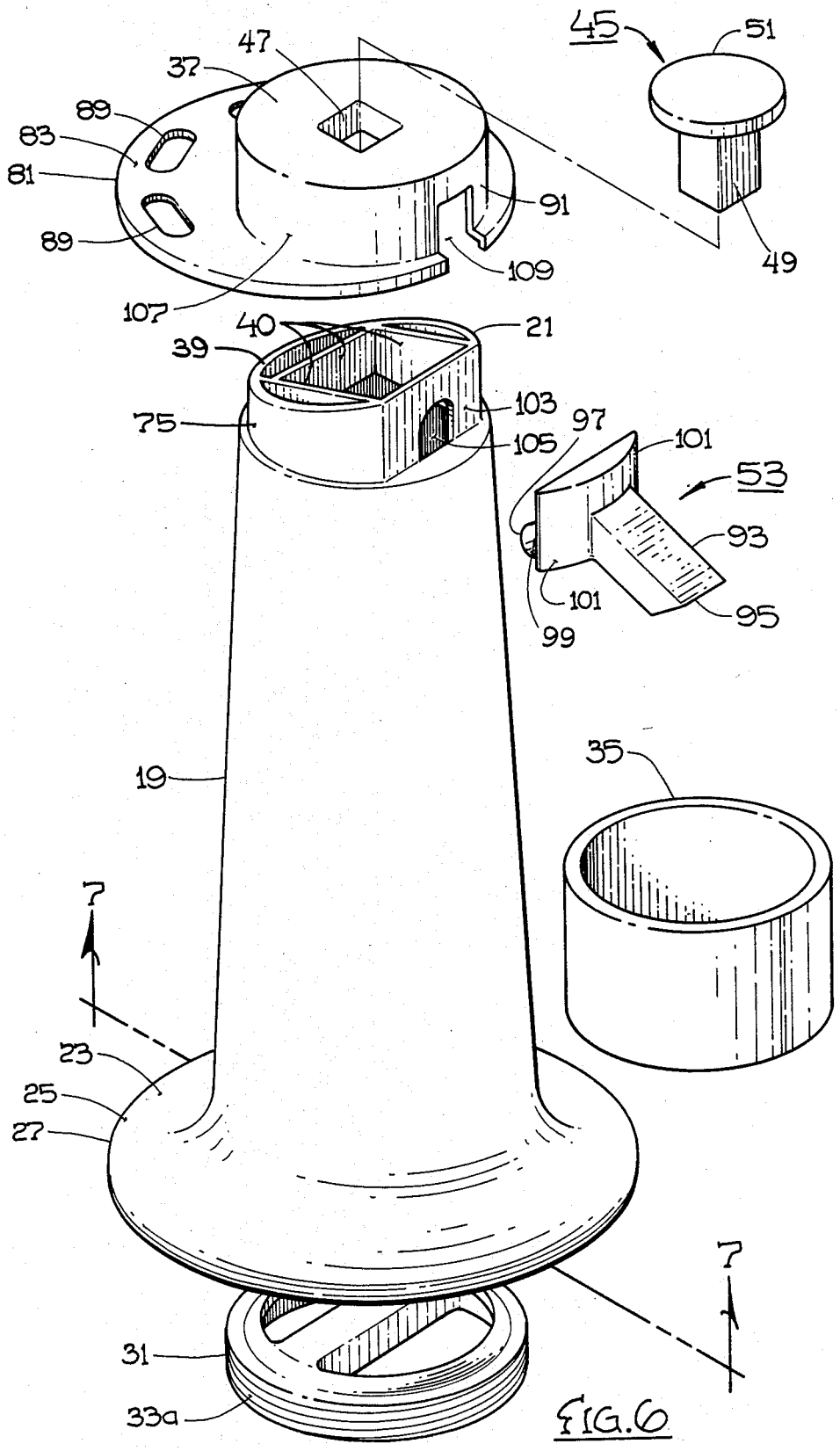
FIG. 6 is an exploded perspective view of another embodiment of the combination toothpaste dispenser and toothbrush holder of this invention.
Figure 7:
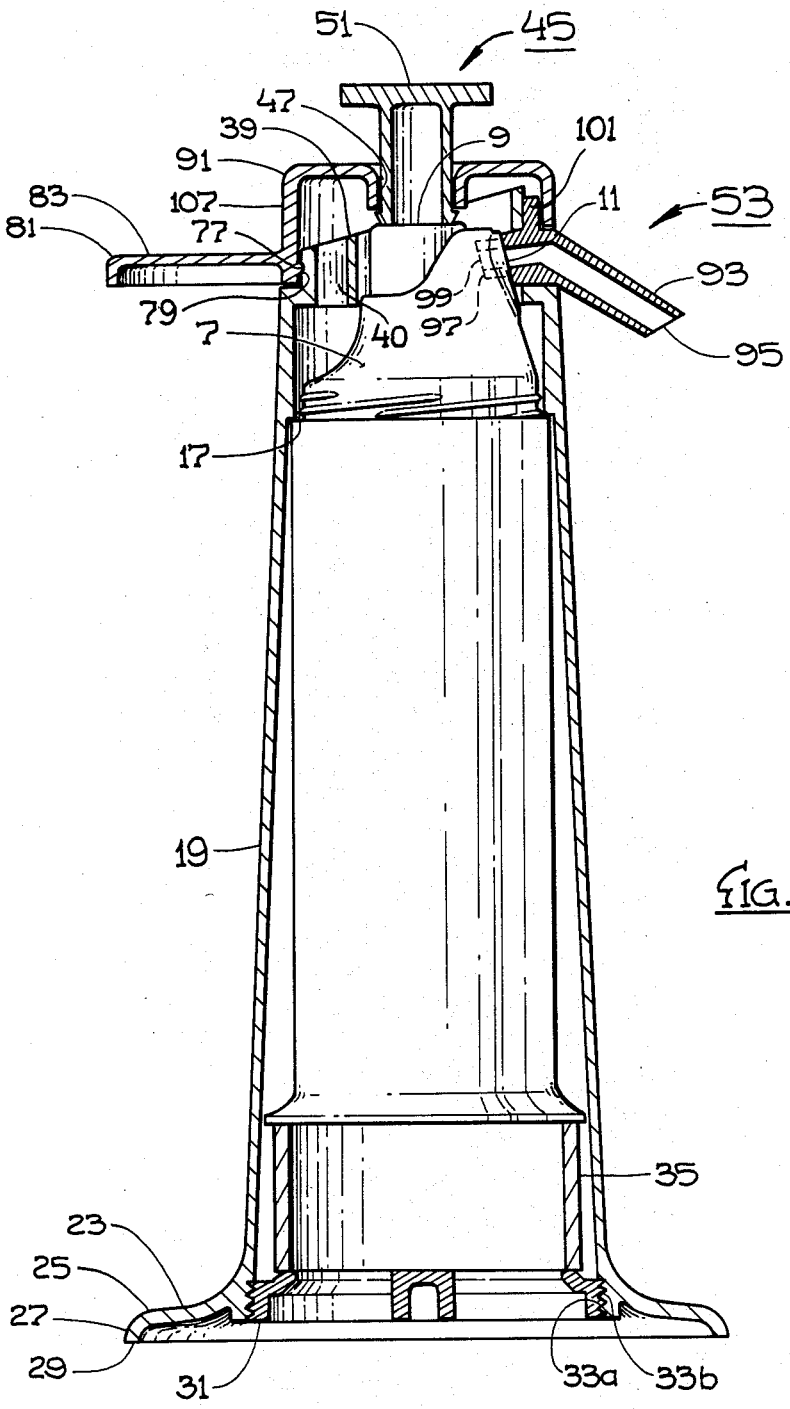
FIG. 7 is a side elevational view, partly in section, taken along lines 7—7 in FIG. 5 showing a pump-tube inserted therein and ready for use.

As shown in FIGS. 6 and 7, this invention includes a second preferred embodiment for use with another type of commercially available pump-tube dispenser, said dispenser having the same elements but in a slightly different geometry. As shown, said embodiment comprises mostly the same elements of the embodiment shown in FIGS. 3 and 4, such as housing 19, with its upper end 21 and lower end 23, outwardly flared base flange 25 bordered by perimeter 27 to form flat base 29, and having a base plug 31 installable in base 29, optionally usable with an extension 35, to be held therein by interconnecting threads 33*a* and 33*b*. A pump 37 is provided at housing upper end 21 that contains a plate 39 formed from a series of webs 40 that extend downward to abut shoulder 17 and other portions of pump-tube dispenser top 7. In this embodiment, however, a closure cap 91 is provided to cover plate 39 and includes plunger means 45 that includes passageway 47, centered over pump-tube plunger 9. Because of the upwardly angled direction of dispenser port 11 in this embodiment, however, a different nozzle means is used. A shown, nozzle means 53 comprises a short, hollow nozzle 93, bounded by exterior nozzle end 95, from which the toothpaste is dispensed, an interior nozzle end 97, containing a narrow dip leg 99 for insertion a short distance into dispenser port 11, and laterally extending flanges 101, extending outward from nozzle 93 exterior of dip leg 99. Plate 39 contains an inwardly spaced, shoulder web 103 that extends downward adjacent port 11 and terminates therebelow. Web 103 contains an aperture 105 that aligns with dispenser port 11. When dip leg 99 is inserted through aperture 105 and into port 11, nozzle flanges 101 seat against shoulder web 103.

Cap 91, further includes vertical annular circumferential side walls 107, that extend downward over plate 39 and seat against groove 75 and may include the raised bump 77—small detent 79 combination of the previous embodiment or some other well known clasping device to hold cap 91 securely thereon. A wide, short slot 109 is formed in cap 91 for registration with web aperture 105 over dispenser port 11 that engages flanges 101 to anchor nozzle 93 tightly against web 103 and against movement from the stresses imposed by the toothpaste being pumped through nozzle 93. Bracket 81 and its associated shelf 83, containing apertures 89 in which to hang toothbrushes, are made integral with closure cap 91.

In operation, the first shown embodiment is loaded by removing base plug 31, inserting a pump-tube dispenser of toothpaste, aligning pump passageway 47 with plunger 9, care being taken to allow dip leg 55 to extend into dispenser port 11, and then repositioning plug 31 in base 29 to seat pump-tube shoulder against web 43. Bracket 81 is then lowered into groove 88 and ring 73 slipped into groove 75 and boss 71 snapped into receipt in depression 63, and a bump 77 snapped into engagement with and detent 79. Lastly, pump rod 49 is slipped into passageway 47.

With respect to the second shown embodiment, the pump-tube dispenser is likewise inserted into housing 19, rotated until dispenser port 11 is aligned with web aperture 105 and thereafter seated by base plug 31. Nozzle 93 is then attached by inserting dip leg 99 through aperture 105 and into dispenser port 11. Cap 91 is then snapped over plate 39 in groove 75. Lastly, pump rod 49 is slipped into passageway 47. To obtain toothpaste from either embodiment, one merely holds a toothbrush under exterior nozzle end 67 or 95 and depresses button 51.

While having so described the preferred embodiments, I do not relinquish any rights to changes therein that can be made within the scope and spirit of my invention.

What is claimed is:

1. A combination toothpaste dispenser and toothbrush holder comprising:

(a) a narrow, upstanding paste container tube having a top mounted actuator and spaced-apart dispenser port;

(b) an elongated housing of terminal length extending down over the paste container tube, terminating at its lower end in an outwardly flared, free-standing base flange and including an insertable base plug for retaining the paste container tube coaxially therein;

(c) detachable nozzle means connected to an aperture in the housing at its upper end;

(d) a hollow dip leg interiorly of the housing and disposed at the upper end thereof for partially penetrating the dispenser port to form a non-leaking seal therebetween, said hollow dip leg being in fluid communication with said aperture in the housing and said nozzle means;

(e) a bracket extending outward from said housing, said bracket having a series of apertures formed therein for receipt therethrough of handles of toothbrushes to be hung thereon; and (f) an exposed actuator reciprocally mounted in said housing at its upper end for registration with the actuator of the paste container tube disposed within said housing, whereby toothpaste is discharged from the dispenser port and conveyed out from said housing through said nozzle means in response to pressure applied to said exposed actuator.

2. The combination toothpaste dispenser and toothbrush holder of claim 1 wherein said exposed actuator comprises a button mounted atop a rod, adapted to be pressed downward by hand to force said rod to depress the actuator and force toothpaste out of the paste container dispenser port through said detachable nozzle means.

3. The combination toothpaste dispenser and toothbrush holder of claim 1 wherein said housing is cylindrical.

4. The combination toothpaste dispenser and toothbrush holder of claim 1 wherein said insertable base plug is adapted to engage fastening means mounted within said housing to retain the paste container tube in fixed position therein.

5. The combination toothpaste dispenser and toothbrush holder of claim 1, further including a plug extension of terminal length for insertion ahead of said base plug and against the base of said paste container tube to allow said housing to accept paste container tubes of various lengths.

6. The combination toothpaste dispenser and toothbrush holder of claim 1 wherein said nozzle means includes a mounting ring extending therefrom for seating engagement in a groove formed in and encircling said upper end of said housing.

7. A combination toothpaste dispenser and toothbrush holder comprising:

(a) a narrow, upstanding paste container tube having a top mounted actuator and spaced-apart dispenser port;

(b) an elongated housing of terminal length extending down over the paste container tube, terminating at its lower end and an outwardly flared, free-standing base flange and including an insertable base plug for retaining the paste container tube coaxially therein;

(c) detachable nozzle means extending into an aperture in the housing at its upper end, said nozzle means including a hollow dip leg at one end thereof for partially penetrating the dispenser port to form a non-leaking seal therebetween;

(d) a cap mounted to the top of the housing;

(e) a bracket extending outward from said cap and said housing, said bracket having a series of apertures formed therein for receipt therethrough of handles of toothbrushes to be hung thereon; and (f) an exposed actuator reciprocally mounted in said cap for registration with the actuator of the paste container tube disposed within said housing, whereby toothpaste is discharged from the dispenser port and conveyed out from said housing through said nozzle means in response to pressure applied to said exposed actuator.

8. The combination toothpaste dispenser and toothbrush holder of claim 7 wherein said exposed actuator comprises a button mounted atop a rod, adapted to be pressed downward by hand to force said rod to depress the actuator and force toothpaste out of the paste container-tube dispenser port through said detachable nozzle means.

9. The combination toothpaste dispenser and toothbrush holder of claim 7 wherein said housing is cylindrical.

10. The combination toothpaste dispenser and toothbrush holder of claim 7 wherein said insertable base plug is adapted to engage fastening means mounted within said housing to retain the paste-container tube in fixed position therein.

11. The combination toothpaste dispenser and toothbrush holder of claim 7 further including a plug extension of terminal length for insertion ahead of said base plug and against the base of said paste container-tube to allow said housing to accept paste container-tubes of various lengths.

12. The combination toothpaste dispenser and toothbrush holder of claim 7 wherein said cap comprises a removable closure cap and said nozzle means includes a pair of flanges, extending therefrom adapted to be held between said cap and said upper end of said housing.

* * * * *